US005261573A

United States Patent [19]

Jouillat et al.

[11] Patent Number: 5,261,573

[45] Date of Patent: Nov. 16, 1993

[54] MANUAL PRECOMPRESSION PUMP

[75] Inventors: Claude Jouillat, Montigny-sur-Avre; Michel Brunet, Sainte-Colombe-la-Commanderie, both of France

[73] Assignee: Societe Technique de Pulverisation - S.T.E.P., Verneuil-sur-Avre, France

[21] Appl. No.: 761,215

[22] Filed: Sep. 17, 1991

[30] Foreign Application Priority Data

Sep. 17, 1990 [FR] France ..... 90 11465

[51] Int. Cl.[5] ..... B67D 5/40

[52] U.S. Cl. ..... 222/321; 141/20

[58] Field of Search ..... 222/321, 385, 402.1, 222/402.2, 402.16; 239/333; 141/3, 20

[56] References Cited

U.S. PATENT DOCUMENTS

| | | | |
|---|---|---|---|
| 4,917,156 | 4/1990 | Varlet | 141/20 |
| 4,944,432 | 7/1990 | Jouillat | 222/385 |
| 4,964,547 | 10/1990 | Lina | 222/385 |

FOREIGN PATENT DOCUMENTS

| | | | |
|---|---|---|---|
| 342651 | 11/1989 | European Pat. Off. | 222/385 |
| 2620052 | 9/1987 | France . | |
| 2626851 | 5/1988 | France . | |
| 2632359 | 6/1988 | France . | |
| 48115 | 4/1977 | Japan | 222/385 |
| 873383 | 7/1961 | United Kingdom | 141/20 |
| 1056382 | 1/1967 | United Kingdom | 222/402.16 |

*Primary Examiner*—Andres Kashnikow
*Assistant Examiner*—Philippe Derakshani
*Attorney, Agent, or Firm*—Sughrue, Mion, Zinn, Macpeak and Seas

[57] ABSTRACT

A manual precompression pump for spraying or dispensing a fluid substance contained in a receptacle, said pump having a pump body (1) in which a hollow piston (2) slides the piston being extended by a hollow rod (3) including the seat (7a) for a closure valve member (6) urged towards said hollow rod by a spring (10), said spring pushing the valve member (6) and the piston (2) towards a rest position, said pump including a pump chamber (12) which is in communication with the receptacle when the valve member and the piston are in their rest positions, said pump chamber (12) being capable of being isolated from the receptacle by sealed interfitting of a first cylinder (8) integral with the valve member (6) and of a second cylinder (4) integral with the pump body, said pump being characterized in that a valve rod (7b) extends the valve member (6) through the hollow rod (3) to a distance H1 beyond the outside end of the hollow rod, and in that starting from the rest position of the valve member, the cylinder (8) integral with the valve member can be moved towards the cylinder (4) integral with the pump body through a distance H2 which is greater than H1 without the interfitting between the two cylinders becoming sealed.

7 Claims, 4 Drawing Sheets

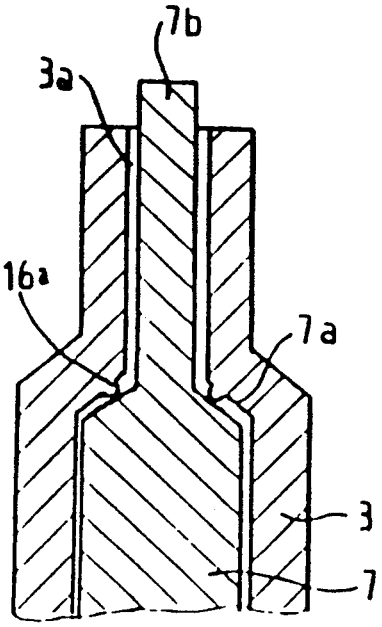
FIG. 6
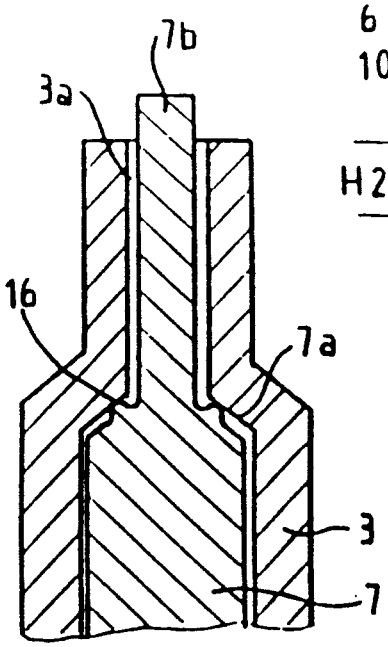
FIG. 5
FIG. 4
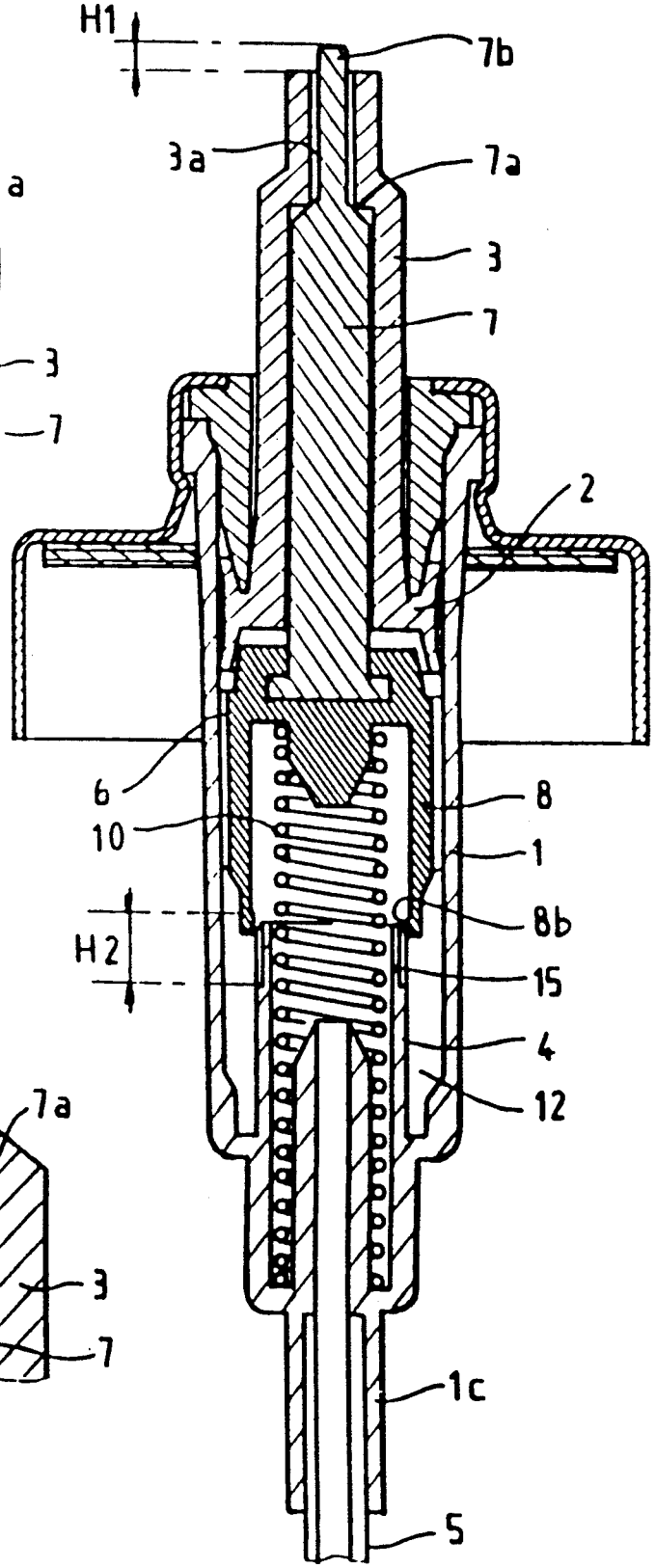

MANUAL PRECOMPRESSION PUMP

BACKGROUND OF THE INVENTION

The present invention relates to a manual precompression pump for spraying or dispensing a fluid such as a liquid or a semi-liquid substance, e.g. a perfume, a cosmetic, or a pharmaceutical.

Accompanying FIG. 1 shows one example of such a pump, disclosed in particular in French patents Nos. 2 305 241 and 2 314 772, and in U.S. Pat. No. 4 025 046. The pump comprises a hollow pump body 1 having an axis of revolution, provided with an annular bottom 1*a* pierced by a central orifice 1*b* and extended externally by a cylindrical side wall which extends vertically upwards to a top end. A narrower tubular portion 1*c* extends vertically downwards from the bottom 1*a*, and a tubular endpiece 4 extends vertically upwards from said bottom 1*a* to a top end of said endpiece 4. The diameter and the height of the endpiece 4 are smaller than the diameter and the height respectively of the side wall of the pump body.

The pump body 1 is mounted in the neck of a receptacle (not shown) containing a substance to be sprayed or dispensed, and it is fixed therein by any appropriate means, e.g. using a crimped metal capsule. The narrower tubular portion 1*c* is situated inside the receptacle and a dip tube 5 may optionally be fitted in said tubular portion 1*c*.

A piston 2 is slidably mounted inside the pump body 1. The piston 2 is hollow and shares the same axis of revolution as the pump body 1. The piston 2 preferably includes at least one outer peripheral sealing lip 2*a* bearing resiliently against the cylindrical side wall of the pump body 1. The piston is extended vertically upwards by a hollow rod 3 to a top end of said rod. The rod 3 includes a central channel 3*a* which extends from a bottom end of said channel to the top end of the rod.

The pump further includes a valve member 6 likewise sharing the same axis of revolution as the pump body 1. The valve member 6 comprises a plug 7 for closing the bottom end of the channel 3*a* which forms a seat 7*a* for the plug, and a cylindrical skirt 8 extending vertically downwards to a bottom end, said skirt 8 being capable of fitting over the tubular endpiece 4 of the pump body. The skirt 8 is guided in its motion by vertical outer ribs 8*a* sliding against the side wall of the pump body. Advantageously the bottom end of the skirt includes an inside peripheral sealing lip 8*b* to seal against the tubular endpiece 4 when the skirt is fitted over said endpiece 4. The pump is closed by an added ferrule, 11 with the hollow rod 3 sliding therein, and which is fixed to the pump body, for example by ultrasonic welding or by some other conventional means. The ferrule 11 thus constitutes a top abutment for the motion of the piston inside the pump body. At rest, the spring urges the piston against the ferrule 11 via the plug 7. In this position, the skirt 8 of the valve is disengaged from the tubular endpiece 4 so that an annular passage 13 is opened between these two parts.

The pump constituted in this manner delimits a pump chamber 12 between the tubular endpiece 4 and the side wall of the pump body 1. To explain the operation of the pump it is assumed that the pump chamber is full of the substance to be dispensed or sprayed.

When the user presses down the rod 3, generally by means of a pushbutton (not shown), the piston 2 moves down inside the pump body taking the valve member 6 with it against the thrust of the spring 10. During this downwards motion, the skirt 8 fits over the tubular endpiece 4 thereby closing the annular passage 13, and thus isolating the pump chamber 12.

The downwards motion of the piston tends to reduce the volume of the pump chamber 12. However since the liquid or semi-liquid substance contained therein is incompressible, this motion rapidly causes the pressure to increase in said pump chamber, with said pressure exerting downwards action on the valve member 6. When the pressure inside the pump chamber is sufficient to counterbalance the thrust from the spring 10, the plug 7 of the valve member 6 moves away from its seat 7*a*, thereby opening a passage from the pump chamber 12 towards the channel 3*a* in the rod. The substance contained in the pump chamber thus escapes through this passage as the piston moves down inside the pump body.

This downwards motion stops when the bottom end of the skirt 8 comes into abutment against the bottom 1*a* of the pump body. The pressure in the pump chamber reduces because piston motion has stopped, thereby causing the channel 3*a* to be closed by the plug 7 which is again pressed resiliently against its seat 7*a* by the spring 10.

When the user releases thrust on the rod 3, the spring 10 returns the valve 6 upwards, taking with it the piston 2. At the beginning of this upwards motion, the pump chamber 12 is isolated by the skirt 8 fitting over the tubular endpiece 4 and by the plug 7 being pressed against its seat 7*a*. The upwards displacement of the piston 2 thus creates suction. When the piston 2 comes into abutment against the ferrule 11, the skirt 8 disengages from the endpiece 4, thereby opening the annular passage 13. Because of the suction in the pump chamber 12, the substance contained in the dip tube 5 and in the receptacle is sucked into the pump chamber, which is thus filled again.

The inside sealing lip 8*b* formed at the bottom end of the skirt 8 could be replaced by an outside sealing lip formed on the top end of the tubular endpiece 4.

Instead of the skirt 8 fitting over an endpiece 4 projecting from the bottom 1*a* of the pump body, the pump could have a pump body side wall including a cylindrical bottom portion of smaller diameter above the bottom 1*a* and in which a cylinder integral with the valve member 6 is received. In which case a sealing lip could be provided either on the smaller diameter bottom portion of the pump body or on the cylinder integral with the valve member 6, for the purpose of improving the sealing between these two parts when fitted together.

Other variants of this type of pump are known to the person skilled in the art.

The pump of the type described above may be used with a receptacle that is closed in sealed manner and in which the substance to be sprayed or to be dispensed is maintained under pressure by a dissolved gas (freon) or by a non-dissolved gas (nitrogen). The purpose of the gas may be to keep the substance out of contact with the atmosphere so as to avoid it being polluted or oxidized. The gas may also serve to facilitate pump priming and to ensure that the pump chamber is filled more completely and more quickly. When the gas is used in this way, it is difficult to inject the propellant gas into the receptacle after said receptacle has been filled with substance and the pump has been installed and fixed in place.

One solution to this problem is proposed in French patent No. 2 620 052 granted to Valois, European patent application EP-0 307 310 and U.S. Pat. No. 4 964 547. The endpiece 4 is provided with external projections 14 close to the bottom 1*a* of the pump body, as shown in accompanying FIG. 2. To inject a gas into the receptacle, a needle is inserted down the channel 3*a* of the rod and pressed against the plug 7 of the valve member 6 with sufficient force to lower the valve member inside the pump chamber and cause the sealing lip 8*b* to ride up onto the external projections of the endpiece. In normal use, the force exerted on the rod 3 by a user is not sufficient to move the sealing lip 8*b* onto the projections 14. The plug moving away from its seat 7*a* releases a first passage between the pump chamber and the channel 3*a*, and moving the sealing lip 8*a* onto the external projections 14 of the endpiece releases a second passage between the pump chamber and the receptacle. The gas can then be injected into the receptacle via the channel 3*a*.

That solution suffers from several drawbacks. Firstly, it requires a special gas filler head including a needle for pressing down the plug 7. Such filler heads are more difficult to position and more expensive than conventional filler heads that do not include a needle.

In addition, pushing the sealing lip 8*b* onto the projections 14 causes the sealing lip 8*b* to be subjected to considerable stress and this may give rise to plastic deformation that damages the sealing provided by said lip 8*b*.

Finally, to facilitate engaging the needle on the plug 7, the plug 7 is generally made relatively long so that its seat 7*a* is close to the top end of the rod 3. Since the valve member 6 is generally made all in one piece, out of a material that is relatively flexible such as low density polyethylene, such a long plug 7 may give rise to large amounts of plastic or elastic deformation during successive occasions the pump is actuated. Such deformation changes the position of the valve member 6 relative to the piston 2 and to the rod 3, thereby changing the quantity of substance that is delivered each time the pump is actuated.

It may also be advantageous for the pump chamber to be put into communication simultaneously with the receptacle and the channel 3*a*, not for the purpose of injecting a gas into the receptacle, but in order to establish suction to prime the pump and cause the substance to move up from the receptacle into the pump chamber, and/or for the purpose of removing undesirable gases from said substance. This can be achieved using the apparatus of the above-mentioned Valois patent, with the drawbacks already mentioned.

SUMMARY OF THE INVENTION

A particular aim of the present invention is to avoid these drawbacks.

The present invention thus provides a manual precompression pump for spraying or dispensing a fluid substance contained in a receptacle, said pump comprising:

a hollow cylindrical pump body provided with an admission orifice in communication with the receptacle;

a hollow piston sliding inside said pump body and extended by a hollow rod to a top end, said hollow rod including a valve seat;

a valve member for closing said hollow rod;

resilient means urging said valve member towards said hollow rod in such a manner as to press said valve member against said valve seat in sealed manner, and in such a manner as to urge said valve member and said piston towards a rest position; and a pump chamber delimited by the pump body, the piston, and the valve member, said pump chamber communicating with the receptacle via the admission orifice when the valve member and the piston are in their rest position, said pump chamber being capable of being isolated from the receptacle by sealed interfitting of a first cylinder integral with the valve member and of a second cylinder integral with the pump body, each of these two cylinders having a first end that is close to the other cylinder;

said pump being characterized in that a valve member rod extends the valve member through the hollow rod to a first distance H1 beyond the outside end of the hollow rod, and in that starting from the rest position of the valve member, the cylinder integral with the valve member can be moved towards the cylinder integral with the pump body through a second distance H2 greater than H1 without the interfitting of the two cylinders becoming sealed.

The cylinder integral with the pump body and the cylinder integral with the valve member are separated at rest by the distance H2 that is greater than H1, or else one of the interfitting cylinders is provided with substantially longitudinal fluting at its end close to the other cylinder and over a length such that starting from the rest position of the valve member, the cylinder integral with the valve member can be moved towards the cylinder integral with the pump body through a distance H2 greater than H1 without the interfitting of the two cylinders becoming sealed.

Advantageously, the valve member is molded in two parts:

a first part pressed resiliently against the valve seat under thrust from the spring, said first part being made of a rigid material; and a second part integral with said first part, said second part being made of a flexible material and including said cylinder integral with the valve member that co-operates with the cylinder of the pump chamber to isolate said pump chamber by means of the two cylinders interfitting. Advantageously, said second part is overmolded on a portion of said first part.

The valve member may include a plug pressed resiliently against said valve seat to close the hollow rod. The plug may include a peripheral sealing lip which is resiliently applied against the valve seat, or the valve seat may include a peripheral sealing lip against which the plug is pressed resiliently.

BRIEF DESCRIPTION OF THE DRAWINGS

In the drawings.

FIG. 4 is a vertical section view through a pump constituting another embodiment of the present invention; and FIGS. 5 and 6 are vertical section views through the plug and the valve seat in a variant of the invention.

DETAILED DESCRIPTION OF THE PREFERRED EMBODIMENTS

Figure 1:
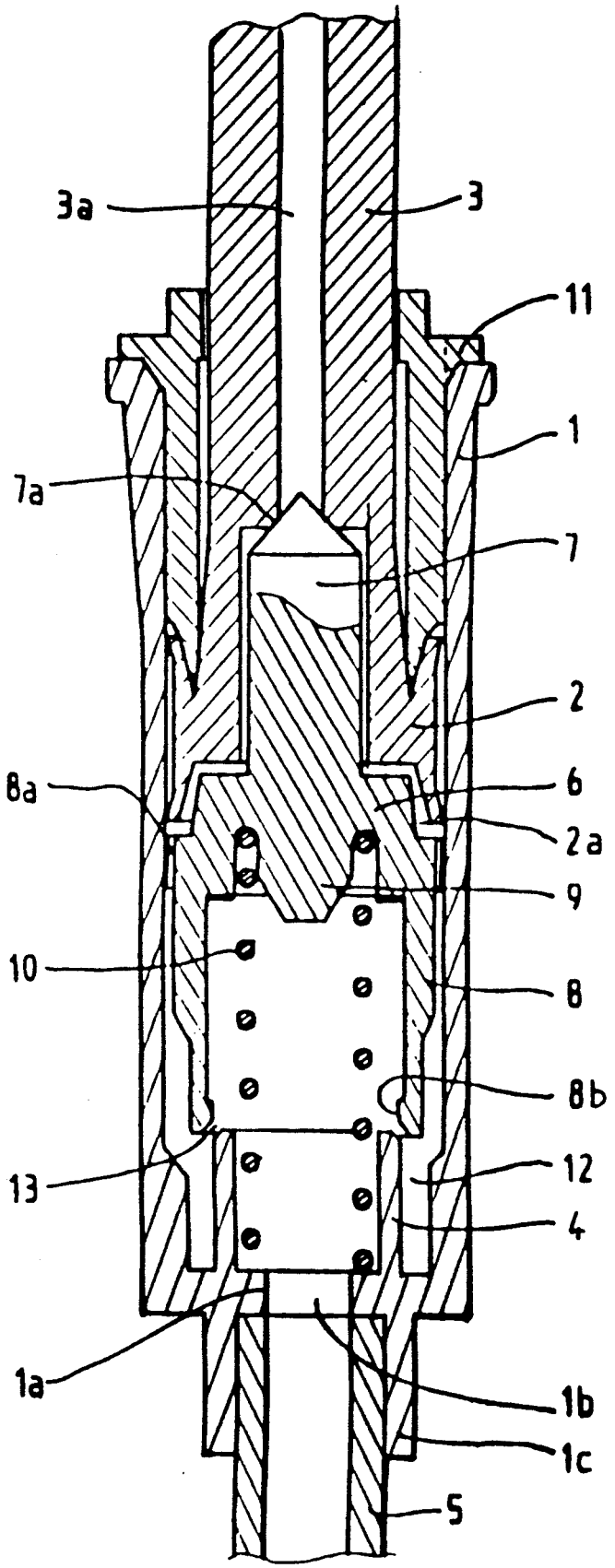
FIG. 1 PRIOR ART
FIG. 1 is a vertical section view through a prior art pump of French patent Nos. 2 305 241 and 2 314 772.
Figure 2:
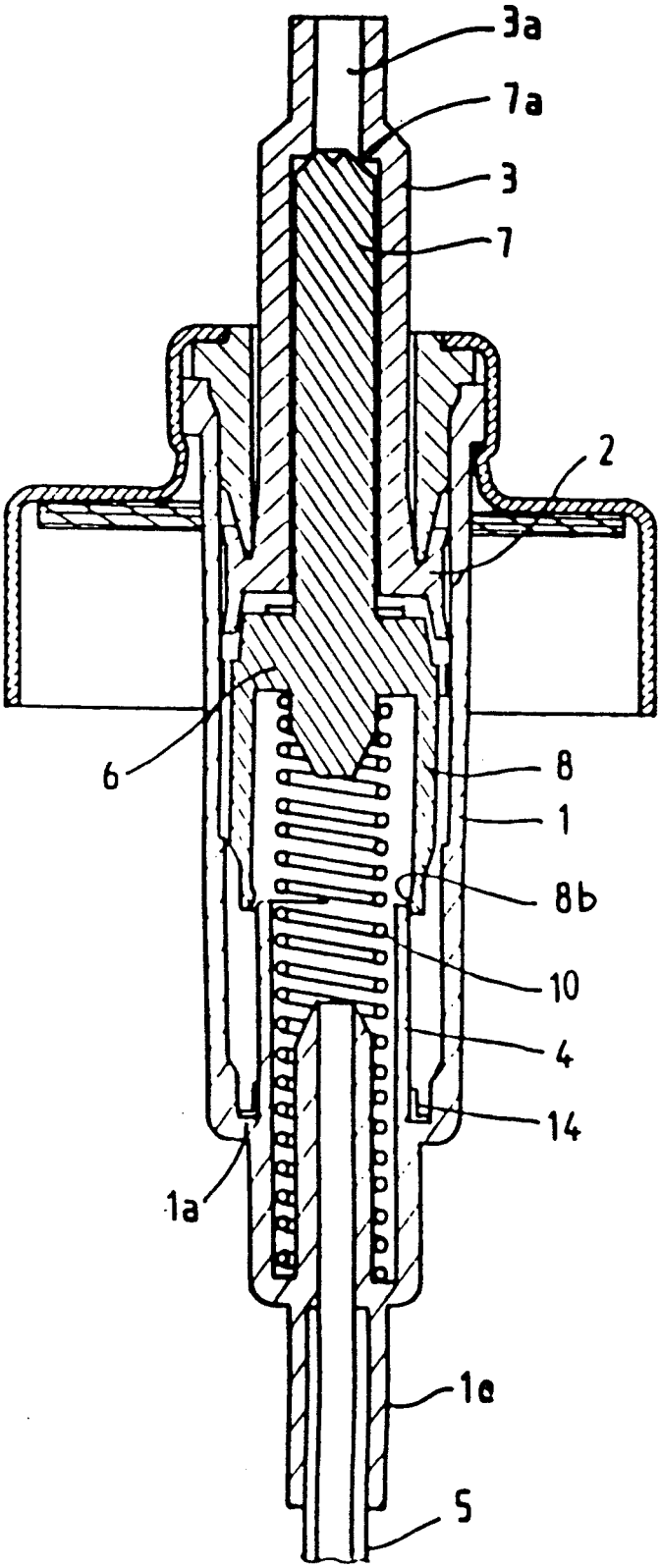
FIG. 2 PRIOR ART
FIG. 2 is a vertical section view through another prior art pump of French patent No. 2 620 052.
Figure 3:
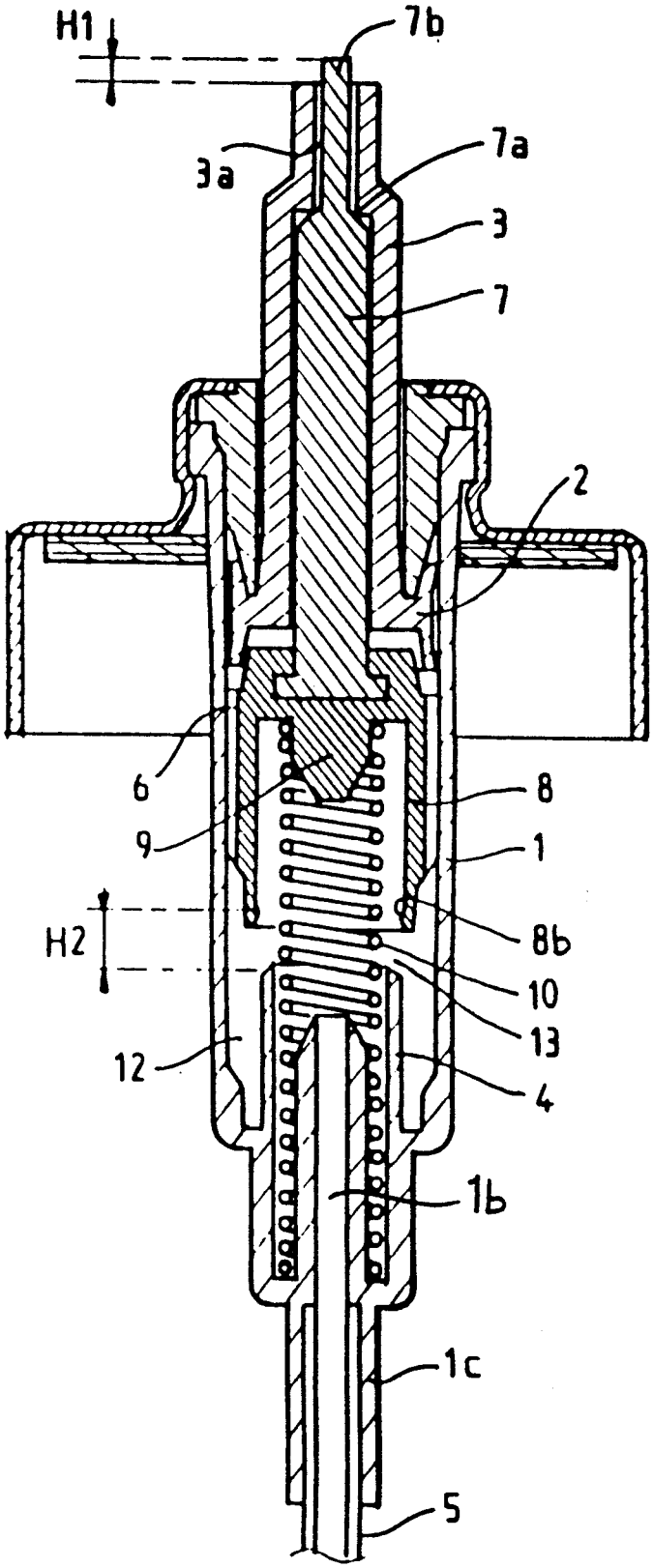
FIG. 3 is a vertical section view through a pump constituting an embodiment of the present invention.

FIG. 3 shows a manually actuated precompression pump of the type described above with reference to FIGS. 1 and 2, and additionally including certain characteristics that are specific to the present invention. The references for items described above remain unchanged, and they are not described again below.

The valve member 6 is altered relative to the above description. Firstly the plug 7 is extended vertically upwards by a rod 7*b* which extends along the channel 3*a* and projects a height H1 above the top end of the hollow rod 3. In addition, the tubular endpiece 4 is shorter than in FIG. 2 such that when the valve member 6 moves down inside the pump body 1, it begins by describing lost motion of length H2 where H2 is greater than H1, and during which the annular space 13 between the skirt 8 and the endpiece 4 remains open.

If the rod 7*b* is pressed down so that it no longer projects above the hollow rod 3, a passage is thus opened between the pump chamber 12 and the channel 3*a* by the plug 7 moving of its seat 7*a*, and the annular passage 13 between the pump chamber 12 and the receptacle remains open since the valve member 6 moves down only through a height H1 which is less than the height H2 required for the skirt 8 to close the annular space 13 by fitting over the endpiece 4.

In this position, it is thus possible to inject a gas into the receptacle via the channel 3*a*, or on the contrary to establish suction in said channel to prime the pump and/or to remove unwanted gases from the substance contained in the receptacle.

These operations may be performed with a conventional gas filler head, that does not include a needle, and that is fed with gas under pressure or that is connected to suction, depending on the desired operation. In addition, the sealing lip 8*a* of the skirt is not subjected to deformation, and therefore does not run the risk of being damaged.

In order to stiffen the narrow section rod 7*b*, its length is minimized by placing the seat 7*a* of the plug close to the top end of the hollow rod 3, as is the case for the pump shown in FIG. 2. This high position for the plug-receiving seat 7*a* has the advantage of reducing the length of the channel 3*a*, which represents a retention volume for substance that is in contact with ambient air and where the substance may be polluted or oxidized. In addition, the presence of the rod 7*b* in the channel 3*a* further reduces the retention volume represented by the channel.

The high position of the plug-receiving seat 7*a* also facilitates molding the part constituting the rod and the piston by minimizing the length of the channel 3*a* which is small in section and thus difficult to mold.

Advantageously, the valve body is molded in two parts:

a first part constituting the plug 7 and its rod 7*b*, and provided in this case with a bottom end in the form of an enlarged head, this part is molded out of rigid plastic, e.g. PBT; and a second part fixed to the first part and comprising in particular the skirt 8 of the valve, the second part being molded out of flexible plastic such as low density polyethylene, for example. The second part is advantageously overmolded onto the first part and contains the enlarged head of the first part.

In FIG. 3, the positioning finger 9 for the spring is integrally molded with the second part made of flexible material. However, it could equally well be constituted by an extension of the first part which is made of rigid material.

With this two-part design for the valve member, because the plug 7 is rigid there is no danger if deforming, while the skirt 8 nevertheless has the flexibility to perform its sealing function.

FIG. 4 shows a variant of the FIG. 3 pump in which the tubular endpiece 4 is not shortened, but instead includes substantially axial outer fluting 15 so as to obtain lost motion for the valve member 6 over the same height H2 as before, during which the pump chamber 12 continues to communicate with the receptacle via the fluting 15. The operation of this pump is thus identical to the operation of the pump shown in FIG. 3.

As shown in FIG. 5 the plug 7 may have a peripheral sealing lip 16 pressed against the plug-receiving seat 7*a*, thereby providing good sealing. The sealing lip 16*a* could equally well be made on the plug-receiving seat 7*a*, as shown in FIG. 6.

The above detailed description is given with respect to a pump in which the valve member 6 includes a skirt 8 that fits over an endpiece 4 projecting from the bottom 1*a* of the pump body for the purpose of isolating the pump chamber 12 from the receptacle containing the substance. Without going beyond the scope of the present invention, this isolation could equally well be achieved by fitting a solid cylinder of the valve member in a reduced diameter cylindrical bottom portion of the pump body. In general, the pump body is thus isolated from the receptacle by two cylinders interfitting, the first cylinder being integral with the valve member 6, and a second cylinder being integral with the pump body 1.

The sealing lip may be disposed on one or other of these cylinders without going beyond the scope of the present invention.

We claim:

1. A manual precompression pump for spraying or dispensing a fluid substance contained in a receptacle, said pump comprising:

a hollow cylindrical pump body (1) provided with an admission orifice (1*b*) in communication with the receptacle;

a hollow piston (2) sliding inside said pump body and extended by a hollow actuation rod (3) to a top end, said hollow actuation rod including a valve seat (7*a*);

a valve member (6) for closing said hollow rod (3);

resilient means (10) urging said valve member (6) towards said hollow rod (3) in such a manner as to press said valve member (6) against said valve seat (7*a*) in a sealed manner, and in such a manner as to urge said valve member (6) and said piston (2) towards a rest position;

a pump chamber (12) delimited by the pump body (1), the piston (2), and the valve member (6), said pump chamber communicating with the receptacle via the admission orifice (1*b*) when the valve member and the piston are in their rest position, said pump chamber (12) being capable of being isolated from the receptacle by sealed engagement between a first cylinder (8) integral with the valve member (6) and a second cylinder (4) integral with the pump body, each of said cylinders having a first end that is close to the other cylinder; and a valve member rod (7*b*) extending the valve member (6) through the hollow rod (3) to a first distance H1 beyond an outside end of the hollow rod such that, starting from the rest position of the valve member, the cylinder (8) integral with the valve member can be moved towards the cylinder (4) integral with the pump body through a second distance H2 greater than H1 without any sealing engagement between said cylinders, thereby enabling fluid to be introduced into or evacuated from the receptacle.

2. A pump according to claim 1, in which the cylinder (4) integral with the pump body and the cylinder (8) integral with the valve member are separated at rest by the distance H2 that is greater than H1.

3. A pump according to claim 1, in which one of the interfitting cylinders is provided with substantially longitudinal fluting at its end close to the other cylinder and over a length such that starting from the rest position of the valve member, the cylinder (8) integral with the valve member can be moved towards the cylinder (4) integral with the pump body through a distance H2 greater than H1 without the interfitting of the two cylinders becoming sealed.

4. A pump according to claim 1, in which the valve member (6) is molded in two parts:

a first part (7) pressed resiliently against the valve seat (7*a*) under thrust from the spring (10), said first part being made of a rigid material; and a second part integral with said first part, said second part being made of a flexible material and including said cylinder (8) integral with the valve member that co-operates with the cylinder (4) of the pump chamber to isolate said pump chamber by means of the two cylinders interfitting.

5. A pump according to claim 4, in which said second part is overmolded on a portion of said first part.

6. A pump according to claim 1, in which the valve member (6) includes a plug (7) pressed resiliently against said valve seat (7*a*) to close the hollow rod (3), and the plug (7) includes a peripheral sealing lip (16) pressed resiliently against the valve seat (7*a*).

7. A pump according to claim 1, in which the valve member (6) includes a plug (7) pressed resiliently against said valve seat (7*a*) to close the hollow rod (3), and the valve seat (7*a*) includes a peripheral sealing lip (16*a*) against which the plug (7) is pressed resiliently.

* * * * *